US006056595A

United States Patent [19]

Passwater et al.

[11] Patent Number: 6,056,595

[45] Date of Patent: May 2, 2000

[54] UNIVERSAL SIGNAL TRANSMITTER FOR A THERMOCOUPLE CONNECTOR HEAD

[75] Inventors: Grant W. Passwater, Fort Wayne; David A. Stauffer, Spencerville, both of Ind.

[73] Assignee: Sensortec, Inc., Huntertown, Ind.

[21] Appl. No.: 09/056,202

[22] Filed: Apr. 6, 1998

[51] Int. Cl.[7] ..... H01R 13/60

[52] U.S. Cl. ..... 439/570; 439/569

[58] Field of Search ..... 439/570, 569, 439/709

[56] References Cited

U.S. PATENT DOCUMENTS

D. 360,596 7/1995 Moritz et al. .

5,052,950 10/1991 Wilson ..... 439/709

*Primary Examiner*—Paula Bradley
*Assistant Examiner*—Alexander Gilman
*Attorney, Agent, or Firm*—Taylor & Aust, P.C.

[57] ABSTRACT

A terminal block is disclosed having a pair of detachable tab portions enabling the terminal block to accommodate a mounting arrangement involving either a round-shaped housing unit resembling a DIN-style module or an oval-shaped housing unit resembling a U.S.-style module. In a first configuration of the terminal block, the detachable tab portions are removed to permit the terminal block to be mounted within a round-type terminal connector head. In a second configuration of the terminal block, the detachable tab portions remain connected to the terminal block to permit the terminal block to be mounted within an oval-type terminal connector head.

15 Claims, 2 Drawing Sheets

UNIVERSAL SIGNAL TRANSMITTER FOR A THERMOCOUPLE CONNECTOR HEAD

BACKGROUND OF THE INVENTION

1. Field of the invention.

The present invention generally relates to terminal blocks for use in terminal connector heads, and, more particularly, to an adaptive terminal block and body capable of being mounted within connector heads of various types.

2. Description of the related art.

Terminal connector heads are commonly used with temperature sensors to serve as a device for interconnecting the sensor leads to input terminals of a control processor. A temperature sensor typically includes a temperature sensing elements such as a thermocouple, which is encased in a protective tube. The sensing element supplies or varies an electrical signal to provide an indication of the temperature level within a monitored environment. The electrical signal needs to be transmitted to a process instrument for suitable translation into usable information available for analysis. Such a process instrument might be a digital processor in combination with an analog-to-digital converter.

Terminal connector heads find particular use with temperature sensors because these sensing devices typically have short wires, preventing their direct connection to a remote facility. Terminal blocks provided in the form of an RTD-type transmitter are mounted within the terminal connector heads and interconnect the thermocouple to the process instrumentation. Standard connector heads includes a housing and a cover, in which the housing is provided with a process opening and an instrument opening. The protection tube or sheath of material surrounding a temperature sensing element is typically threaded at one end and threadably inserted into a nut adaptor formed at the process opening of the housing. The relevant wires of the sensing element are connected to the appropriate input terminals of the terminal block mounted within the housing. Connecting wires attached to the output terminals of the terminal block are routed through the instrument opening of the housing and suitably connected to the control and analysis equipment currently in use. During operation when the sensor is obtaining the relevant measurements, the interior compartment of the housing is sealed from adverse environmental conditions using the cover and by appropriately designing the terminal connector head and terminal block to withstand the expected conditions. For example, the terminal block may be formed of a high temperature ceramic while the connector head may be formed of a durable metal housing tailored to absorb significant impacts.

Industry use of terminal connector heads features two distinct types of transmitter housing heads. The DIN style commonly found in European applications employs a mounting surface for the terminal block characterized by a substantially circular design on the order of 33 mm hole diameters. By comparison, the U.S. style used in domestic applications involves an oval-shaped housing providing a substantially elliptical mounting surface for the terminal block. The consequence of such disparate and incompatible mounting arrangements has meant that conventional systems are required to provide one terminal block having circular dimensions to fit within the DIN style housing head and another terminal block having oval dimensions to fit within the U.S. style housing head. This duplication of what is essentially the same component (except for the shape of the mounting surface) has heretofore been the prevailing condition within the relevant application fields, representing a diseconomy affecting the cost of the overall system and constituting an inefficient use of parts.

SUMMARY OF THE INVENTION

The present invention relates to a terminal block with a body having a pair of detachable tab portions enabling the terminal block to accommodate a mounting arrangement involving either a round-shaped housing unit resembling a DIN-style module or an oval-shaped housing unit resembling a U.S.-style module. In a first configuration of the terminal block, the detachable tab portions are removed to permit the terminal block to be mounted within a round-type terminal connector head. In a second configuration of the terminal block, the detachable tab portions remain connected to the terminal block to permit the terminal block to be mounted within an oval-type terminal connector head.

As used in this application, the term terminal block is defined as an electronic component to connect together various electrical wires, including such components that connect together wires while operating as a signal conditioning device. Typical signal conditioning devices that are terminal blocks for this application include, but are not limited to, transmitter devices for use with RTDs, thermistors, thermocouples, and other measuring devices. Signal conditioning devices other than transmitters may also be utilized as terminal blocks.

The invention comprises, in one form thereof, a terminal block for use in a terminal connector head, the terminal connector head being provided in one of a first head type and a second head type. The terminal block comprises a body and a pair of tab elements each integrally associated with the body and each defining a structure for use in mounting the terminal block to the terminal connector head. Each one of the pair of tab elements includes a first tab portion and an associated second tab portion, the second tab portion being detachably connected to the associated first tab portion. The first tab portion is used for mounting the terminal block to the terminal connector head when of the first head type and accompanied by the detachment of the second tab portion therefrom. The second tab portion is used for mounting the terminal block to the terminal connector head when of the second head type. The first head type of the terminal connector head includes, in one form thereof, a circular mounting surface in the respective terminal connector head; and the second head type of the terminal connector head includes, in one form thereof, an elliptical mounting surface in the respective terminal connector head.

The first tab portion of each one of the pair of tab elements provides a slot, while the second tab portion of each one of the pair of tab elements includes a first ear section and an associated second ear section defining a slot therebetween which is registered with the slot provided by the first tab portion associated therewith. For each one of the pair of tab elements, the second tab portion is detachably connected to the associated first tab portion at a groove formed therebetween.

The invention comprises, in another form thereof, a terminal block for use in a terminal connector head, the terminal block being operative in a first configuration thereof for attachment to a terminal connector head of a first type, the terminal block being operative in a second configuration thereof for attachment to a terminal connector head of a second type. The terminal block comprises a body and a pair of tab elements each integrally connected to the body and each including a first tab portion and an associated second tab portion, the second tab portion being detachably connected to the associated first tab portion. The terminal block in the first configuration thereof is secured to the terminal connector head of the first type using the first tab portion in accompaniment with the detachment of the second tab portion therefrom. The terminal block in the second configuration thereof is secured to the terminal connector head of the second type using the second tab portion. The first type of the terminal connector head includes, in one form thereof, a circular mounting surface in the terminal connector head; and the second type of the terminal connector head includes, in one form thereof, an elliptical mounting surface in the terminal connector head.

The first tab portion of each one of the pair of tab elements provides, in one form thereof, a slot; and the second tab portion of each one of the pair of tab elements includes, in one form thereof, a first ear section and an associated second ear section defining a slot therebetween which is registered with the slot provided by the first tab portion associated therewith. Each of the first ear section and the second ear section associated with the second tab portion of each one of the pair of tab elements is detachably connected, in a preferred form thereof, to the first tab portion associated therewith at a respective groove which is sufficient to enable detachment of the respective ear section thereat.

The invention comprises, in another form thereof, a terminal block for use in a terminal connector head, the terminal connector head being characterized by one of a first mounting arrangement and a second mounting arrangement with respect to the terminal block. The terminal block comprises a body and at least one tab element extending from the body. The at least one tab element includes a first tab portion permitting the attachment of the terminal block to the terminal connector head according to the first mounting arrangement, and further includes a second tab portion detachably connected to the first tab portion and permitting the attachment of the terminal block to the terminal connector head according to the second mounting arrangement. The first mounting arrangement, in one form thereof, is compatible with a circular mounting surface in the terminal connector head, while the second mounting arrangement, in one form thereof, is compatible with an elliptical mounting surface in the terminal connector head.

The at least one tab element comprises, in one form thereof, a first tab element extending from the body at one side thereof; and a second tab element extending from the body at another side thereof.

The first tab portion of each of the first tab element and the second tab element provides, in one form thereof, a slot, while the second tab portion of each of the first tab element and the second tab element includes an associated first ear section and second ear section defining a slot therebetween which is registered with the slot provided by the first tab portion associated therewith.

The invention comprises, in yet another form thereof, a terminal block for use in a terminal connector head, the terminal block being operative in a first configuration thereof for attachment to a terminal connector head of a first type, the terminal block being operative in a second configuration thereof for attachment to a terminal connector head of a second type. The terminal block comprises a body and a means, integrally associated with the body, for defining a structure permitting the attachment of the terminal block in the second configuration thereof to the terminal connector head of the second type and being adaptive to permit the attachment of the terminal block in the first configuration thereof to the terminal connector head of the first type, wherein the first configuration of the terminal block is effected by the adaptive action. The terminal connector head of the first type includes, in one form thereof, a circular mounting surface; and the terminal connector head of the second type includes, in one form thereof, an elliptical mounting surface.

The structure defining means comprises, in one form thereof, a pair of tab elements each integrally connected to the body and each including a first tab portion and an associated second tab portion, the second tab portion being detachably connected to the associated first tab portion. The first tab portion is used for attaching the terminal block to the terminal connector head when of the first type and in accompaniment with the detachment of the second tab portion therefrom. The second tab portion is used for attaching the terminal block to the terminal connector head when of the second type.

The first tab portion of each one of the pair of tab elements provides, in one form thereof, a slot; and the second tab portion of each one of the pair of tab elements includes, in one form thereof, a first ear section and an associated second ear section defining a slot therebetween which is registered with the slot provided by the first tab portion associated therewith. The slot provided by the first tab portion of each one of the pair of tab elements is preferably sufficient to accommodate a screw extending therethrough for securing the terminal block to the terminal connector head at the respective first tab portion. The slot defined between the first ear section and the second ear section associated with the second tab portion of each one of the pair of tab elements is preferably sufficient to accommodate a screw extending therethrough for securing the terminal block to the terminal connector head at the respective second tab portion.

The invention comprises, in yet another form thereof, a terminal block for use in a terminal connector head, the terminal block being operative in a first configuration thereof for attachment to a terminal connector head of a first type, the terminal block being operative in a second configuration thereof for attachment to a terminal connector head of a second type. The terminal block comprises a body including a pair of mounting elements, and a pair of tab elements detachably connected to the body. The terminal block in the first configuration thereof is secured to the terminal connector head of the first type using the pair of mounting elements of the body in accompaniment with the detachment of the pair of tab elements. The terminal block in the second configuration thereof is secured to the terminal connector head of the second type using the pair of tab elements. Each one of the pair of tab elements, in one form thereof, is detachably connected at least in part to a respective one of the pair of mounting elements. Each one of the pair of tab elements, in another form thereof, is detachably connected in full to a respective section of the body. The first type of the terminal connector head includes a circular mounting surface therein; and the second type of the terminal connector head includes an elliptical mounting surface therein.

One advantage of the present invention is that the terminal block disclosed herein affords a dual-purpose use in which the same terminal block unit can be adaptively configured for mounting within either a round-type or oval-type terminal connector head by implementing the appropriate modifications (i.e., removal of the detachable tab portions for the round-type head).

Another advantage of the present invention is that the terminal block affords a universal application with respect to the disparate DIN-style European head designs and U.S.-style head designs, eliminating the need to provide two separate housing-specific terminal blocks as required by conventional systems.

Yet another advantage of the present invention is that the particular adaptation enabling the terminal block disclosed herein to realize its universal feature requires a simple structural change (i.e., removal of a detachable tab portion) that is easily implemented and does not diminish the overall design integrity.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 4:
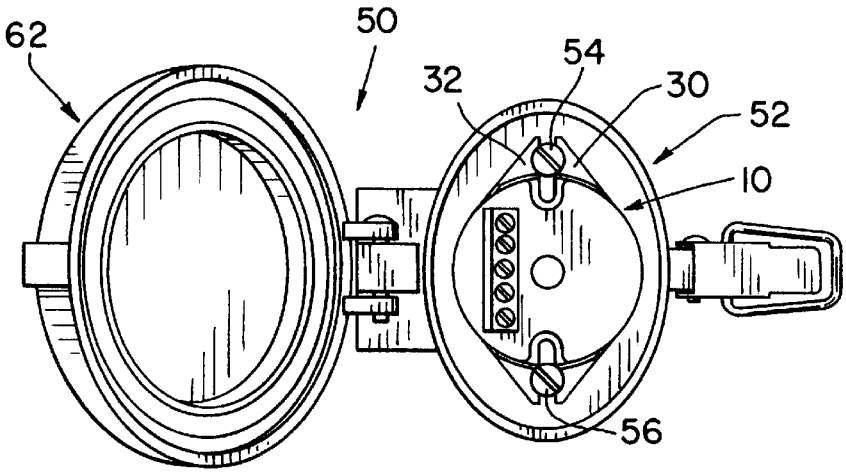
FIG. 4 is a pictorial view of the same oval-type housing arrangement as depicted in FIG. 3 in which a terminal block according to another aspect of the present invention is illustratively mounted therein.
Figure 5:
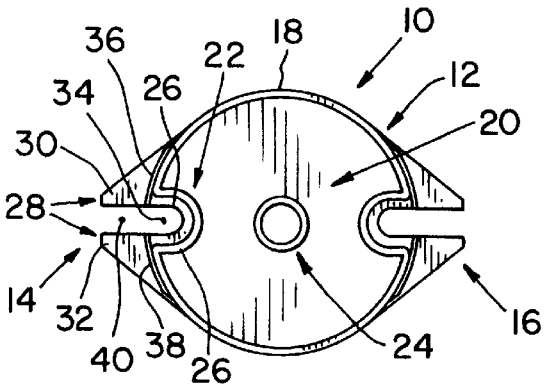
FIG. 5 is an upper plan view of the terminal block according to the present invention as provided in one configuration thereof having its detachable tab portions left intact.
Figure 6:
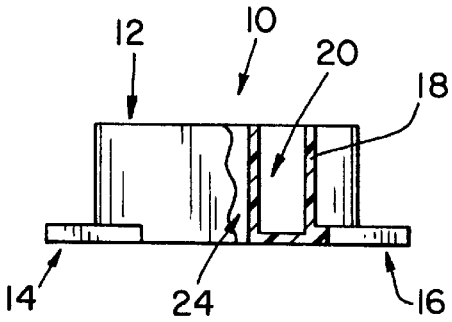
FIG. 6 is a lateral view taken in partial cut-away section of the terminal block of FIG. 5.
Figure 7:
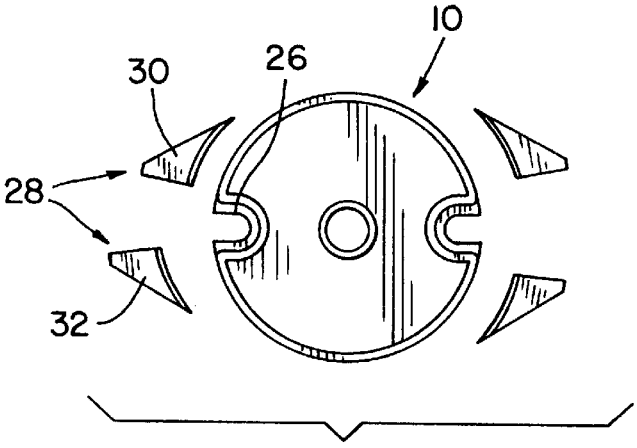
FIG. 7 is an upper plan view of the terminal block according to the present invention as provided in another configuration thereof having its detachable tab portions removed.

Referring initially to FIGS. 5–7, there is shown a set of pictorial illustrations depicting a terminal block according to the present invention provided in a first and second configuration thereof. In particular, FIG. 5 is an upper plan view of the terminal block as provided in its original configuration with the detachable tab portions left intact, while FIG. 7 is an upper plan view of the terminal block as provided in its adapted configuration with the detachable tab portions having been removed. FIG. 6 is a lateral view taken in partial cut-away section of the terminal block of FIG. 5. The terminal block configuration illustrated by FIG. 5 permits the as-constructed terminal block to be mounted in the oval-type housing unit of FIG. 3, with the fully assembled unit being shown in FIG. 4. By comparison, the as-adapted terminal block configuration illustrated by FIG. 7 allows the modified terminal block to be mounted in the round-type housing unit of FIG. 1, with the fully assembled unit being shown in FIG. 2.

Referring to FIGS. 5 and 6, there is shown respectively an upper plan view and a lateral partial cut-away view of terminal block 10 in accordance with one embodiment of the present invention. The illustrated terminal block 10 includes a body 12 and a pair of tab elements 14 and 16 preferably disposed in integral connecting fashion to body 12 on opposite sides thereof. For purposes of brevity and not in limitation hereof, the discussion relating to tab element 14 applies equally to tab element 16 since in a preferred form of terminal block 10 both of the tab elements 14 and 16 share a common structure and function.

Body 12 is generally provided in the form of a substantially cylindrical shell or casing structure closed at a lower end (visible in the FIG. 5 view) and open at an upper end to enable an electrical component or other suitable device to be placed within the receptacle area generally indicated at 20 that is bounded by circumferential wall 18. The illustrated wall 18 takes the shape of an inwardly-facing rounded indent at a region thereof indicated generally at 22, but otherwise retains a substantially circular profile. Body 12 is provided with a passageway 24 formed as a hollow tube-shaped upstanding pillar affording the ability to route wires from the back-side (i.e., the mounted side) of terminal block 10 to the front side thereof for connection to the component or device being held therein. The term "electrical component" as used herein encompasses any device or structure having at least the ability to transmit signals received at an input terminal thereof to an output terminal thereof including, but not limited to, a terminal strip, passive circuitry, and active circuitry such as may involve signal processing or other forms of signal conditioning.

The particular structure and dimensions of body 12 should not serve as a limitation herein as it should be apparent that any type, form, or arrangement of body 12 may be used in connection with the present invention. As will become more apparent below, the construction of body 12 is generally guided by the objective of ensuring that the as-modified terminal block resulting from the removal of the detachable tab portions retains a mounting area compatible with a round-type terminal connector head. Body 12 is preferably formed of a durable thermoplastic or other suitable material depending upon the expected sensing conditions.

The illustrated tab element 14 includes a first tab portion 26 and an associated second tab portion 28 detachably connected to first tab portion 26 and comprising a first ear section 30 and an associated second ear section 32. Both tab portions 26, 28 are preferably planar formations ordered in their structure and orientation to establish a suitable mounting structure and/or arrangement for use in securably mounting terminal block 10. The first tab portion 26 is illustratively provided in the form of a horseshoe-shaped planar structure integrally formed to body 12 at its lower end and having an upper surface sufficient to permit the head of a mounting screw extending through slot 34 to rest in secure abutting contact therewith. First tab portion 26 is generally representative of any arrangement providing a mounting structure for use in securing terminal block 10 into a substantially circular receiving area. The indent region 22 of wall 18 has first tab portion 26 extending therefrom at an outer surface thereof. By designing first tab portion 26 so that it is compatible with round-type heads (i.e., it does not extend beyond the circular perimeter of body 12 in a manner preventing registration of terminal block 10 with round-type heads), the as-adapted terminal block 10 will be able to retain a generally circular mounting surface at the lower end of body 12 when second tab portion 28 is removed. This circular mounting surface is then suitable to serve as the mounting platform with respect to the round-type terminal connector head. In particular, after detachment of second tab portion 28, the mounting end of the modified terminal block 10 is compatible at least with the round-type European DIN terminal connector head.

The illustrated second tab portion 28 includes first ear section 30 and its associated second ear section 32. Each ear section 30, 32 is detachably connected to first tab portion 26 (in part) and to body 12 (in part). However, it should be understood that the ear sections 30, 32 of second tab portion 28 may alternatively be provided in an arrangement in which the ear sections 30, 32 are detachably connected to only body 12, to only first tab portion 26, or to body 12 in part and to first tab portion 26 in part (as illustrated). This detaching connection is provided, in one form thereof, by a groove 36 formed between first ear section 30 and the relevant sections of body 12 and first tab portion 26, and by a groove 38 formed between second ear section 32 and the relevant sections of body 12 and first tab portion 26. Each groove 36, 38 is sufficient to enable the respective ear section 30, 32 to be removed by being completely broken away at the associated groove via a firm flexing or snap-off action. Alternative means may be provided other than grooves to establish the detaching connection. The illustrated ear sections 30, 32 define a slot 40 formed therebetween that is sufficient to accommodate a mounting screw extending therethrough for securing terminal block 10 to the terminal connector head. This slot 40 is preferably registered with slot 34 provided by first tab portion 26.

The two pairs of illustrated ear sections 30, 32 of terminal block 10 are appropriately designed such that their integral association with body 12 and first tab portion 26 defines, in combination therewith, a contour for the mounting end of the fully intact (i.e., as-constructed) terminal block 10 that substantially corresponds to an elliptical shape compatible at least with the oval-type U.S. terminal connector head. Accordingly, the particular shape of the ear portions may encompass a wide variety of dimensional profiles provided that the resulting detachable tab arrangement effects an elliptical-type mounting surface contour in combination with body 12 and first tab portion 26. Although second tab portion 28 is provided as shown in the form of a pair of ear sections 30, 32, the present invention is not so limited as this tab element may alternatively be provided as a single piece (and hence removed as a unitary whole) or as a multi-piece arrangement each separably removable.

Figure 3:
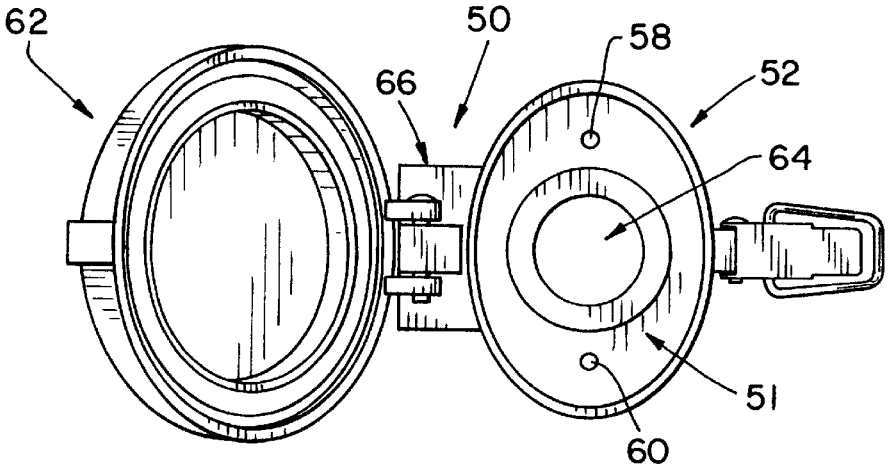
FIG. 3 is a pictorial view of a fully-open conventional oval-type housing arrangement for illustrating an interior view thereof without a terminal block placed therein.

During operation, in the event that an oval-type housing module 50 is being used as shown in FIG. 3 with elliptical mounting area 51, the as-constructed terminal block 10 illustrated in FIG. 5 may be installed directly within the terminal connector head 52, as shown in FIG. 4 in the fully-assembled arrangement. In particular, mounting screws 54, 56 are provided through the respective slots 40 formed at the respective second tab portions 28 (i.e., between ear sections 30, 32 thereof) of terminal block 10 and threadably secured within respective threaded inserts 58 and 60 provided within the mounting area 51 of terminal connector head 52, thereby securably mounting terminal block 10 to connector head 52. As a final measure to prepare for installation, the cover 62 is secured to head 52 by a latch or other suitable locking mechanism to form a closed unit (not shown) fully encasing terminal block 10. The only entry points to the interior are provided by the conventionally known sensor access port 64 and the processor access port shown at 66.

Figure 1:
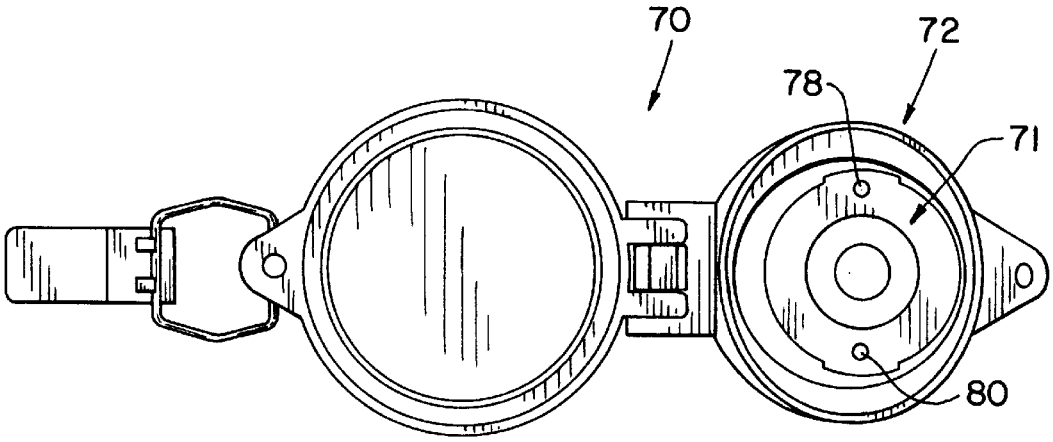
FIG. 1 is a pictorial view of a fully-open conventional round-type housing arrangement for illustrating an interior view thereof without a terminal block placed therein.
Figure 2:
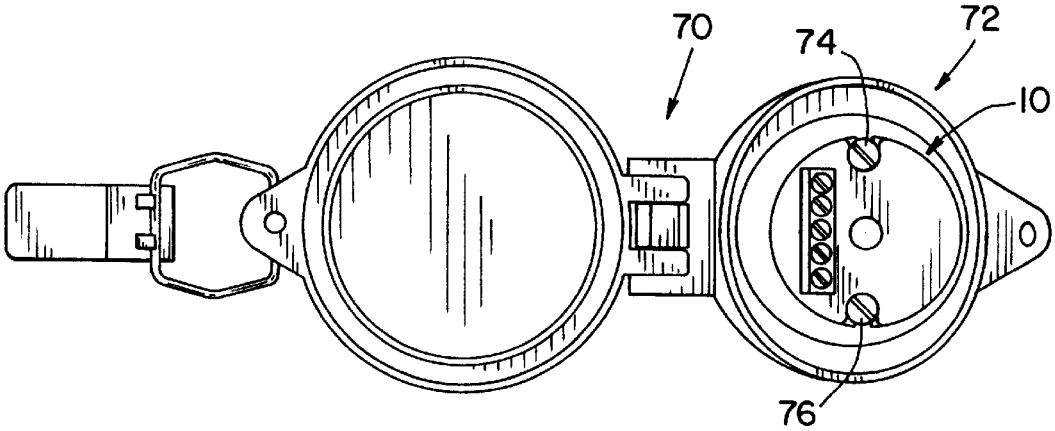
FIG. 2 is a pictorial view of the same round-type housing arrangement as depicted in FIG. 1 in which a terminal block according to one aspect of the present invention is illustratively mounted therein.

During an alternative operation, in the event that a round-type housing module 70 is being used as shown in FIG. 1 with the circular mounting area 71, terminal block 10 is re-configured as shown in FIG. 7 by removing the two pairs of ear sections 30, 32 associated with the respective ones of the second tab portions 28 to produce the modified form of terminal block 10 having the indicated substantially circular contour. Mounting screws 74, 76 are provided through the respective slots 34 formed at the respective first tab portions 26 of terminal block 10 and threadably secured within respective threaded inserts 78 and 80 provided within the mounting area 71 of terminal connector head 72, thereby securably mounting terminal block 10 to connector head 72. The utility of the respective indent regions 22 in body 12 is apparent, namely, they form an effective slot guide providing sufficient room for the round-head mounting screws to access the first tab portions 26.

Although the terminal block disclosed herein provides a functional accommodation with respect to its selectable use within a mounting arrangement involving either a circular or elliptical mounting area, the present invention is not so limited to these particular geometrical configurations. Rather, the terminal block of the present invention encompasses the use of a tab element(s) to provide the capability to alternatively mount the terminal block within either a terminal connector head of a first type corresponding to a first geometrical mounting area (when the terminal block is in its as-constructed configuration) or a terminal connector head of a second type corresponding to a second geometrical mounting area (when the terminal block is in its as-modified configuration with the tab elements removed). The parameters of the second geometrical mounting area would subsist within those of the first geometrical mounting area.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A terminal block for use in a terminal connector head, said terminal connector head being provided in one of a first head type and a second head type, said terminal block comprising:

a body; and a pair of tab elements each integrally associated with said body and each defining a structure for use in mounting said terminal block to said terminal connector head;

wherein each of one said pair of tab elements including a first tab portion and an associated second tab portion, said second tab portion being detachably connected to said associated first tab portion, said first tab portion being used for mounting said terminal block to said terminal connecter head when of said first head type and accompanied by the detachment of said second tab portion therefrom, said second tab portion being used for mounting said terminal block to said terminal connector head when of said second head type;

further wherein:

the first tab portion of each one of said pair of tab elements providing a slot; and the second tab portion of each one of said pair of tab elements including a first ear section and an associated second ear section defining a slot therebetween which is registered with the slot provided by the first tab portion associated therewith; and further wherein:

the slot provided by the first tab portion of each one of said pair of tab elements being sufficient to accommodate a screw extending therethrough for securing said terminal block to said terminal connector head at said respective first tab portion; and the slot defined between the first ear section and the second ear section associated with the second tab portion of each one of said pair of tab elements being sufficient to accommodate a screw extending therethrough for securing said terminal block to said terminal connector head at said respective second tab portion.

2. The terminal block as recited in claim 1, wherein for each one of said pair of tab elements said second tab portion being detachably connected to said associated first tab portion at a groove formed therebetween.

3. The terminal block as recited in claim 1, wherein said second tab portion is detachably connected to said associated first tab portion.

4. The terminal block as recited in claim 1, wherein:

the first head type of said terminal connector head includes a circular mounting surface in said respective terminal connector head; and the second head type of said terminal connector head includes an elliptical mounting surface in said respective terminal connector head.

5. The terminal block as recited in claim 4, wherein said body includes an indent region from which the first tab portion of each one of said pair of tab elements extends.

6. A terminal block for use in a terminal connector head, said terminal block being operative in a first configuration thereof for attachment to a terminal connector head of a first type, said terminal block being operative in a second configuration thereof for attachment to a terminal connector head of a second type, said terminal block comprising:

a body; and a pair of tab elements each integrally connected to said body and each including a first tab portion and an associated second tab portion, said second tab portion being detachably connected to said associated first tab portion;

said terminal block in the first configuration thereof being secured to said terminal connector head of the first type using said first tab portion in accompaniment with the detachment of said second tab portion therefrom;

said terminal block in the second configuration thereof being secured to said terminal connector head of the second type using said second tab portion;

further wherein:

the first tab portion of each one of said pair of tab elements providing a slot; and the second tab portion of each one of said pair of tab elements including a first ear section and an associated second ear section defining a slot therebetween which is registered with the slot provided by the first tab portion associated therewith;

and further wherein:

the slot provided by the first tab portion of each one of said pair of tab elements being sufficient to accommodate a screw extending therethrough for securing said terminal block to said terminal connector head at said respective first tab portion; and the slot defined between the first ear section and the second ear section associated with the second tab portion of each one of said pair of tab elements being sufficient to accommodate a screw extending therethrough for securing said terminal block to said terminal connector head at said respective second tab portion.

7. The terminal block as recited in claim 6, wherein the first ear section and the second ear section associated with the second tab portion of each one of said pair of tab elements each is detachably connected to said first tab portion associated therewith at a respective groove which is sufficient to enable detachment of the respective ear section thereat.

8. The terminal block as recited in claim 6, wherein:

the first type of said terminal connector head includes a circular mounting surface in said terminal connector head; and the second type of said terminal connector head includes an elliptical mounting surface in said terminal connector head.

9. The terminal block as recited in claim 8, wherein said body includes an indent region from which the first tab portion of each one of said pair of tab elements extends.

10. A terminal block for use in a terminal connector head, said terminal connector head being characterized by one of a first mounting arrangement and a second mounting arrangement with respect to said terminal block, said terminal block comprising:

a body;

at least one tab element extending from said body;

said at least on tab element including a first tab portion permitting the attachment of said terminal block to said terminal connector head according to said first mounting arrangement; and said at least one tab element further including a second tab portion detachably connected to said first tab portion and permitting the attachment of said terminal block to said terminal connector head according to said second mounting arrangement;

wherein the first tab portion of each of said first tab element and said second tab element provides a slot which is sufficient to accommodate a mounting screw extending therethrough; and the second tab portion of each of said first tab element and said second tab element includes an associated first ear section and second ear section defining a slot therebetween which is registered with the slot provided by the first tab portion associated therewith and sufficient to accommodate a mounting screw extending therethrough.

11. The terminal block as recited in claim 10, wherein:

said first mounting arrangement being compatible with a circular mounting surface in said terminal connector head; and said second mounting arrangement being compatible with an elliptical mounting surface in said terminal connector head.

12. The terminal block as recited in claim 10, wherein said at least one tab element comprises:

a first tab element extending from said body at one side thereof; and a second tab element extending from said body at another side thereof.

13. The terminal block as recited in claim 10, wherein said first mounting arrangement is compatible with a circular mounting surface in said terminal connector head; and said second mounting arrangement is compatible with an elliptical mounting surface in said terminal connector head.

14. A terminal block comprising:

a terminal connector head, said terminal connector head being provided in one of a first head type and a second head type;

a body; and a pair of tab elements each integrally associated with said body and each defining a structure for use in mounting said terminal block to said terminal connector head;

wherein each one of said pair of tab elements including a first tab portion and an associated second tab portion, said second tab portion being detachably connected to said associated first tab portion, said first tab portion being used for mounting said terminal block to said terminal connector head when of said first head type and accompanied by the detachment of said second tab portion therefrom, said second tab portion being used for mounting said terminal block to said terminal connector head when of said second head type.

15. The terminal block as recited in claim 14, wherein:

the first head type of said terminal connector head includes a circular mounting surface in said respective terminal connector head; and the second head type of said terminal connector head includes an elliptical mounting surface in said respective terminal connector head.

* * * * *

UNITED STATES PATENT AND TRADEMARK OFFICE

CERTIFICATE OF CORRECTION

PATENT NO. : 6,056,595
DATED : May 2, 2000
INVENTOR(S) : Grant W. Passwater, et al.

It is certified that error appears in the above-identified patent and that said Letters Patent is hereby corrected as shown below:

Column 10,
Line 52, after wherein, delete ":";
Line 53, delete "being" and substitute -- is -- therefor;
Line 56, delete "being" and substitute -- is -- therefor.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*